United States Patent [19]

Warnicke

[11] 4,282,850

[45] Aug. 11, 1981

[54] ARCHERY BOW WITH ARROW GUIDE APPARATUS

[76] Inventor: Allen E. Warnicke, P.O. Box 513, Willamina, Oreg. 97396

[21] Appl. No.: 99,274

[22] Filed: Dec. 3, 1979

[51] Int. Cl.[3] ..... F41B 5/00

[52] U.S. Cl. ..... 124/24 R; 124/41 A

[58] Field of Search ..... 124/41 A, 24 R, 35 A, 124/88, 86, 22

[56] References Cited

U.S. PATENT DOCUMENTS

| | | | |
|---|---|---|---|
| 2,665,679 | 1/1954 | Gaskell | 124/24 R |
| 3,135,255 | 6/1964 | Hoyt | 124/24 R |
| 3,406,675 | 10/1968 | Fredrickson | 124/41 A X |
| 3,760,788 | 9/1973 | Hartman | 124/41 A |
| 3,890,951 | 6/1975 | Jennings et al. | 124/41 A |
| 4,038,960 | 8/1977 | Ludwig | 124/41 A |

*Primary Examiner*—Richard C. Pinkham

*Assistant Examiner*—William R. Browne

*Attorney, Agent, or Firm*—Kolisch, Hartwell & Dickinson

[57] ABSTRACT

An archery bow having an arrow guide apparatus for holding and guiding a vaned arrow. The apparatus includes a channel formed in the bow's handle section and three flexible fins mounted at angularly spaced intervals within the channel and projecting radially inwardly therein. The inwardly facing ends of the fins form a guide slot for embracing and guiding an arrow slidably along the arrow's path of release. Upon arrow release, the arrow vanes pass unhindered through associated openings provided between adjacent fins. The flexibility of the fins permits an arrow to be inserted, by forced movement in a direction substantially laterally of the arrow's axis, into the guide slot, and further permits expansion of the effective size of the guide slot to accommodate large diameter arrow shafts.

4 Claims, 4 Drawing Figures

ARCHERY BOW WITH ARROW GUIDE APPARATUS

BACKGROUND AND SUMMARY OF THE INVENTION

The present invention relates to bow arrow guide apparatus, and in particular, to apparatus which can function both to hold an arrow at rest in a bow, and to guide the arrow upon release.

Bow arrow rest devices for maintaining an arrow in a readied position—when the arrow is nocked and the bow string is pulled to a moderate tension—are known in the prior art. Typical of these devices is one having an arrow-engaging member which disengages the arrow when the same is pulled back just before release. Devices such as these do not function to guide the arrow during release.

Also known in the prior art are bow arrow guides which are attachable to the handle portion of a bow to guide an arrow during release. Such guides are constructed to minimize interference with the arrow vanes during release. However, such guides are not constructed to hold an arrow in a readied position, i.e., to function as an arrow rest.

One very general feature of the present invention is to provide bow arrow guide apparatus which functions both to hold a nocked arrow in a readied position, and to guide the arrow when released.

Another object of the invention is to provide such apparatus which permits an arrow to be engaged easily therewith.

Yet another important object of the present invention is to provide such apparatus constructed to allow an arrow to pass therethrough, upon release, without contacting the arrow vanes.

A further object of the present invention is to provide such apparatus which is inexpensive in construction and simple in use.

The present invention includes, in the handle section of a bow, a portion forming a channel dimensioned to permit a multi-vaned arrow to pass unhindered therethrough. A plurality of fins are mounted on the channel-forming portion at angularly spaced intervals, and project radially inwardly therein. The inwardly facing ends of the fins form a guide slot dimensioned to embrace the shaft of an arrow slidably along the arrow's path of release. The vanes of the arrow pass through angularly spaced openings provided between adjacent fins.

In a preferred embodiment of the invention, the apparatus includes three angularly spaced flexible fins which are disposed within a plane substantially normal to the path of arrow release. The flexibility of the fins permits an arrow to be inserted, by forced movement in a direction substantially laterally of the arrow's axis, into the guide slot. Further, with an arrow held in the guide slot, uniform flexion of the fins away from the just-mentioned plane acts to increase the effective size of the guide slot, thus to accommodate different-sized arrow shafts.

These and other objects and features of the present invention will become more fully apparent when read in connection with the following detailed description of a preferred embodiment of the invention, and the accompanying drawings, wherein.

DETAILED DESCRIPTION OF A PREFERRED EMBODIMENT OF THE INVENTION

Figure 1:
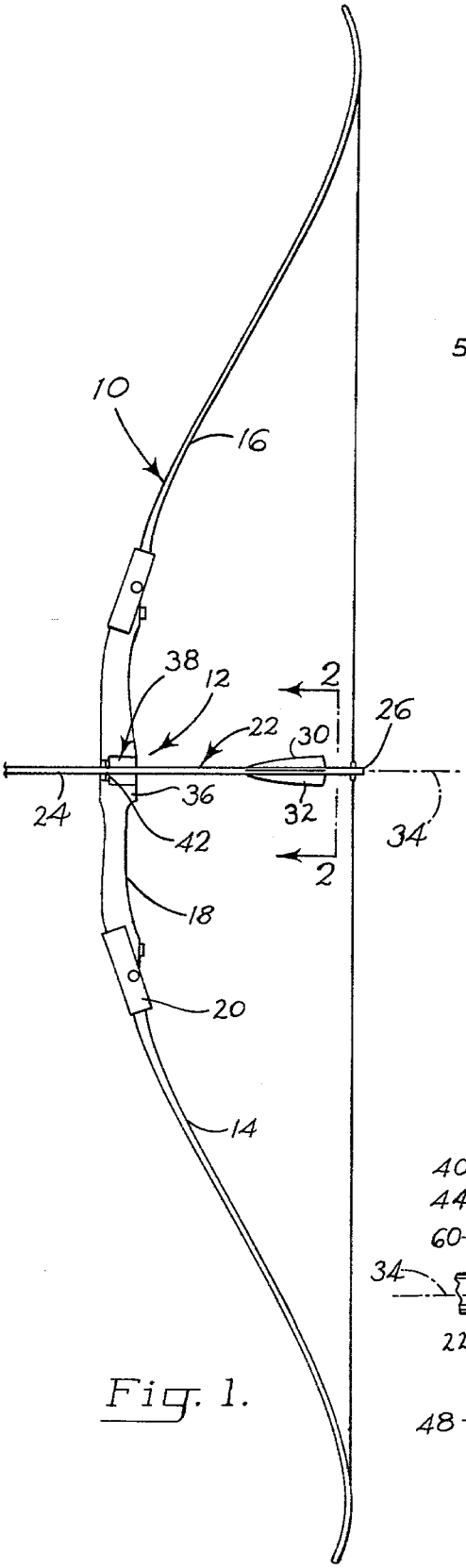
FIG. 1 is a side view of a bow equipped with apparatus of the present invention, and shown here with an arrow held in a readied position.

In FIG. 1 there is shown at 10 a bow equipped with an arrow guide apparatus 12 constructed according to the present invention. Bow 10 generally includes a pair of opposed, resilient arm sections 14, 16, and a substantially rigid handle section 18. The back side of the handle section is toward the left in FIG. 1, and the belly side of the handle section is toward the right in FIG. 1. The two arm sections are releasably attached to section 18, conventionally, by clamps, such as clamp 20 carried on opposed ends of section 18. Apparatus 12 may also be employed in an intergrally constructed, single-piece bow whose handle section is defined roughly as that portion of the bow corresponding to section 18.

Also shown in FIG. 1 is an arrow 22 held in a readied position in the bow. Arrow 22 includes, conventionally, a shaft 24 which carries, adjacent its nock end 26 in FIG. 1, three axially extending, outwardly projecting vanes 28, 30, 32 (see also FIG. 2). When released, arrow 22 travels initially along a path, indicated by dashed-dot line 34 in FIGS. 1, 3 and 4, coincident with its long axis.

Figure 2:
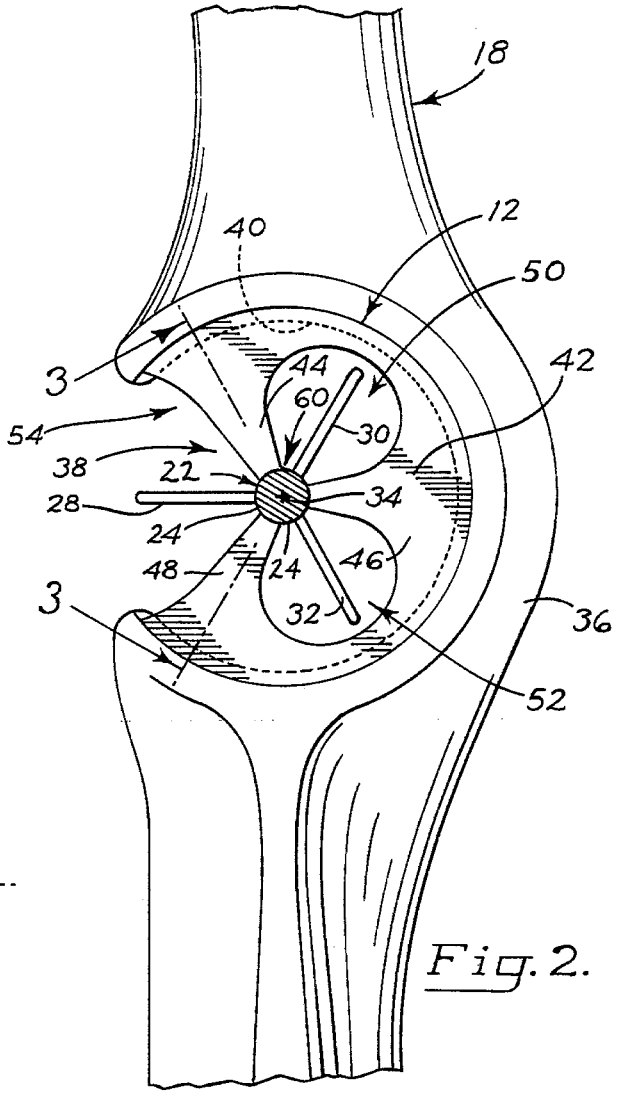
FIG. 2 is an enlarged view taken generally along line 2—2 in FIG. 1.

Looking now at details of apparatus 12, and with particular reference to FIG. 2, section 18 includes an enlarged central portion 36. Formed in this portion, and extending therethrough in the direction of arrow travel is a substantially cylindrical channel 38 including a flange or lip 40 (dotted line in FIG. 2) formed at the forward (left in FIG. 1) channel end. Channel 38, also referred to as a clearance channel, is open along its left side in FIG. 2, and is dimensioned to allow an arrow to pass therethrough, along path 34, without contact between the arrow vanes and the channel wall. Portion 36 is also defined herebelow as means in handle section 18 defining channel 38.

Apparatus 12 further includes a disc-like member 42 having three angularly spaced fins 44, 46, 48 separated by openings 50, 52 and 54, as shown. Member 42 is dimensioned to fit within channel 38, with outer peripheral portions thereof abutting lip 40, being secured thereto by glueing or the like. Thus mounted, member 42 occupies a plane, indicated by dashed line 56 in FIGS. 3 and 4, which is substantially normal to path 34. Member 42 is angularly positioned, within channel 38, to produce alignment between the cutaway portion of the member, forming opening 54, and the open side of the channel, as seen in FIG. 2.

Figure 3:
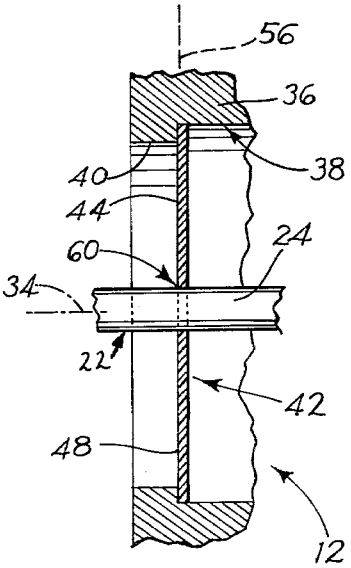
FIG. 3 is a view taken generally along angled line 3—3 in FIG. 2.

With continued reference to FIG. 2, fins 44, 46 and 48 terminate at their radially inward ends, in concavely curved edges. With the fins in a planer, relaxed configuration, as shown in FIG. 3, the just-mentioned curved edges lie on a circle whose diameter is substantially equal to that of the shaft in arrow 22, as can be appreciated with reference to FIGS. 2 and 3. The three arcuate fin edges thus form a circular guide slot 60 dimensioned to embrace the shaft in arrow 22. The three fins are also referred to herebelow as guide means.

With an arrow, such as arrow 22, properly nocked and placed in a readied position in the bow as shown, the arrow vanes assume the angular orientation shown in FIG. 2. As noted above, fins 44, 46 and 48 are angularly spaced such that the openings defined therebetween permit free passage of the three arrow vanes therethrough, during arrow release. More particularly, with arrow 22 held in apparatus 12 as shown in FIG. 2, each fin is diametrically aligned with one of the three arrow vanes.

Member 42 is preferably formed of a single piece of flexible, polymeric sheet material, which is either cut or molded to have the just-described features. A preferred sheet material is polyethylene, having a thickness of between about one and two millimeters. When formed of such material, member 42, and particularly the fins therein, provide two advantageous physical properties which contribute to the functioning of the apparatus. First, the surface edges of the fins, which define slot 60, present a low friction surface along which the shaft of the arrow moves during arrow release. Secondly, flexibility in the fins permits variability in the shape and dimension of slot 60, for purposes to be described more fully below.

Considering now operation of apparatus 12, initially an arrow, such as arrow 22, is nocked, with the arrow oriented as shown in FIGS. 1 and 2. The arrow shaft is snapped into slot 60. In such position, as can be seen with reference to FIG. 2, the arrow shaft is embraced by fins 44, 46 and 48, thus inhibiting any but axial movement of the arrow. Further, and conventionally, axial arrow movement is limited by frictional contact between the arrow nock and the bow string. The arrow so mounted is held in the bow in a readied position from which the bow and arrow can quickly be brought into use.

During arrow release, the arrow shaft is guided along path 34, as the arrow shaft moves slidably through slot 60. As noted above, member 42 is constructed to minimize frictional forces between the arrow shaft and the fins during arrow release. In particular, the arrow-contacting area of slot 60 is quite small by virtue of the limited arcuate dimensions of the fin edges forming the slot, and the thickness of the sheet material forming the fins. Secondly, the polyethylene material forming the fins gives the fin edges a relatively smooth, friction-free surface character. Also as noted above, when the vaned portion of arrow 22 passes through apparatus 12, the arrow vanes are so oriented, to pass unhindered through openings 50, 52, 54. Accordingly, arrow 22 is guided, but not substantially contact-restricted by slot 60 during arrow release. Very significantly, channel 38, and the openings in member 42, provide completely free clearance for the arrows vanes. In other words, such vanes never contact any structure during arrow release.

FIGS. 1–3 illustrate the use and functioning of apparatus 12 with an arrow having one standard-sized shaft diameter. According to an important feature of the present invention, apparatus 12 is designed to accommodate arrows of various shaft diameters. It is obvious how the apparatus can function to hold and guide an arrow having a shaft diameter less than that of arrow 22. The shaft diameter of the minimum sized arrow usable with apparatus 12 must be, of course, somewhat greater than the spacing between the edges of adjacent fins.

Figure 4:
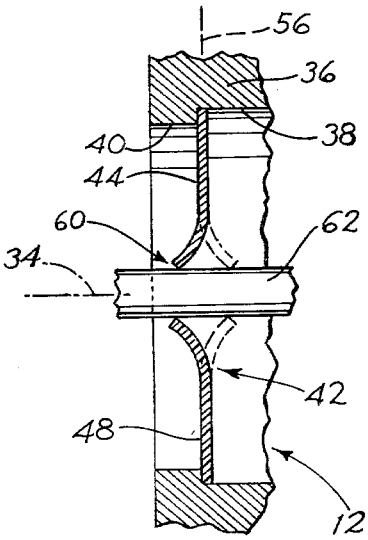
FIG. 4 is a view similar to FIG. 3, but showing configurations of the apparatus with a larger-diameter arrow supported therein.

When an arrow having a shaft diameter greater than that of arrow 22 is used with apparatus 12, the effective size of slot 60 expands by uniform flexion of the three fins out of plane 56. Such is illustrated in FIG. 4 which shows, in a view similar to FIG. 3, a fragmentary portion of an arrow 62 having a relatively large-diameter shaft supported by apparatus 12. As can be seen in this figure, the fins, such as fin 44, 48, have flexed out of plane 56 to increase the effective diameter of the slot. In this configuration, apparatus 12 serves to hold arrow 62 in a readied position. When the arrow, is pulled back,—i.e. toward the right in FIG. 4,—preparatory to release, the fins are pulled in the direction of arrow movement to positions of uniform flexion to the right of plane 56, as shown in dashed lines in FIG. 4. Upon arrow release, as the arrow begins to move toward the left in FIG. 4 along path 34, initial arrow movement in this direction carries the fins to positions of uniform flexion to the left of plane 56, as indicated in solid lines in FIG. 4. Thus, flexion of the fins away from plane 56 occurs in the direction of arrow movement, minimizing frictional contact between the fins and the arrow shaft during arrow release.

From the above, it can be appreciated how the various objects of the present invention are met. In particular, the apparatus of the present invention functions both to hold an arrow in a readied position on a bow, and to guide the arrow during release. Further, during release, the apparatus contacts only the arrow shaft, being constructed to permit the arrow vanes to pass therethrough, unhindered. This permits the arrow from being deflected during release. Further, the construction of the apparatus is such as to provide a substantially friction-free guide surface acting on the arrow shaft during arrow release. Finally, the apparatus of the present invention can be used with arrows having a variety of different shaft diameters, without the user having to make any adjustment in the apparatus.

It will be obvious to those skilled in the art that apparatus 12 may be constructed in various ways. As described herein, the apparatus is formed as part of a discrete bow handle section having a central bulge, or enlarged portion 36, defining the clearance channel. Alternatively, the apparatus may be formed as part of a unitary bow having a central bulge, adjacent the bow handle, which would define the arrow clearance channel.

While there has been described herein one embodiment of an arrow rest having the unique features and advantages just mentioned, it is obvious that various changes and modifications may be made in the present invention without departing from the spirit of the invention.

It is claimed and desired to secure by Letters Patent:

1. In a bow including a handle section bounded by front and rear sides, means in said handle section defining a channel having an axis extending transversely of the handle section and extending from the front and back and the belly sides of the handle section, and means forming an arrow guide in said channel comprising plural, angularly spaced fins, all of a one-piece flexible sheet material, occupying substantially a common plane which plane is disposed substantially normal to the axis of said channel, said fins being mounted on said handle section and projecting radially inwardly from the sides of said channel and terminating at inner ends which are out of contact with each other and which are positioned and arranged to define an opening adapted for the embracing of an arrow shaft, adjacent fins defining an opening therebetween adapted to accommodate the passage of an arrow vane therethrough.

2. The bow of claim 1, wherein said channel has an open side facing laterally of the handle section, a pair of adjacent fins in the means forming the arrow guide defining an opening therebetween which opens up to the open side of said channel.

3. The bow of claims 1 or 2, wherein said means defining a channel further defines a lip extending around the sides of the channel, an expanse of flexible sheet material intergral with the respective fins joins the fins, and said fins are mounted on said handle section by adhering a margin of said expanse to said lip.

4. The bow of claim 2, wherein the plural fins consist of three fins equally angularly spaced from each other, the means defining a channel further defines a lip extending around the sides of the channel, and said fins are mounted on said handle section by an expanse of flexible sheet material integral with the respective fins and including a margin adherred to said lip.

* * * * *